United States Patent [19]

Batts

[11] Patent Number: 4,801,911

[45] Date of Patent: Jan. 31, 1989

[54] SELECTIVE MAGNETIC LIFTING SYSTEM

[75] Inventor: Graham W. Batts, Dunedin, New Zealand

[73] Assignee: White Consolidated Industries, Inc., Cleveland, Ohio

[21] Appl. No.: 95,549

[22] Filed: Sep. 11, 1987

[51] Int. Cl.[4] ..... H01F 7/20

[52] U.S. Cl. ..... 335/289; 335/295

[58] Field of Search ..... 335/289, 290, 291, 292, 335/293, 294, 295

[56] References Cited

U.S. PATENT DOCUMENTS

| | | | |
|---|---|---|---|
| 2,726,752 | 12/1955 | Maher | 335/289 X |
| 3,316,514 | 4/1967 | Radus et al. | 335/291 |
| 3,389,358 | 6/1968 | Tubbs | 335/291 X |

*Primary Examiner*—George Harris

*Attorney, Agent, or Firm*—Pearne, Gordon, McCoy & Granger

[57] ABSTRACT

A method and apparatus for assembling magnetic serpentine coils on a magnetic sheet includes a carriage movable vertically and horizontally and supporting on its lower side a plurality of elongated electromagnets. Permanent magnets are arranged to have an upper surface engageable with the electromagnet and a lower surface having indentations to conform with the tubing. The movement of the carriage and the energization of the electromagnet are controlled so that the electromagnet is energized with a first polarity to attract the permanent magnet members and the serpentine tubing to lift the tubing from a predetermined position and, by movement of the carriage, pick up the tubing, transfer it horizontally to the sheet, and vertically deposit it on the sheet. The electromagnets are then reversed in polarity to cause the permanent magnets to separate from the electromagnets and clamp the tubing on the sheet so that the tubing can be fastened by other methods. After the fastening is complete, the electromagnets are moved into engagement with the permanent magnets and energized to the original polarity to attract the permanent magnets and lift them off the assembled tubing and sheet.

16 Claims, 6 Drawing Sheets

SELECTIVE MAGNETIC LIFTING SYSTEM

BACKGROUND OF THE INVENTION

This invention relates to an apparatus for moving and assembling magnetic members using a combination of permanent magnets and electromagnets. More particularly, the invention uses a movable electromagnet to selectively engage and disengage from a permanent magnet member and to use the permanent magnet both to pick up and move one part into engagement with another and to leave the permanent magnet engaged with the parts to serve as a magnetic clamp.

A particular application for the invention is in the assembly of refrigeration cabinets, where the wall surfaces are used as a heat exchanger for the condenser or evaporator, or both. In the case of food freezers, the outer wall or shell and the inner wall or liner are each cut and punched as necesssary, as generally flat sheets, with all of the wall surfaces in a plane. The tubing for the condenser or evaporator is performed in a tube bending apparatus into a serpentine arrangement generally in accordance with the configuration of tubing is to have when attached to the respective sheet. In the assembly procedures used heretofore, the serpentine is placed loosely on top of the sheet and then moved into final position by sliding the tubing along the surface of the sheet until the exact position is obtained. At this point, the tubing is attached to the sheet by various means such as straps covering the tubing and welded directly to the sheet, or by spot-welding the tube directly to the sheet. With this method of assembly, it is not necessary to have the serpentine arrangement assume the exact configuration prior to assembly, because it is possible to slide it around the sheet as desired, since the tubing is generally quite flexible, and if the tubing has been accidentally somewhat deformed during or after the serpentine bending process, it is easily held in place during the fastening operation without problems. Using this procedure, after the tubing has been held in place, the tubing and walls can be folded along seams into the walls of a box. Prior to complete assembly of the cabinet, it has been customary, to improve the efficiency of operation, to apply a thermal mastic having a high thermal conductivity to the tubing and the adjacent portions of the sheet to improve the thermal transfer from the tubing to the sheet for maximum exchanger efficiency.

According to an assembly procedure as disclosed in copending U.S. patent application Ser. No. 080,750, filed July 31, 1987, assigned to the assignee of this invention and incorporated herein by reference, it has been found that greater efficiency and economy in use of thermal mastic are obtained by first applying beads of thermal mastic to the panel at the location where the tubing serpentine is to be placed, and after the thermal mastic is in place, the tubing is then brought into contact with the sheet. This procedure does not allow any movement of the tubing after it is in contact with the sheet, and therefore it is necessary to hold the tubing in the precise configuration in which it is to be assembled and, while holding it in this configuration, it is moved directly into contact with the sheet in the finished configuration. After this has been done, it is necessary to clamp and hold the tubing serpentine in the same configuration on the sheet until the fastening operation, in the above-mentioned application the application of hot melt adhesive on top of the tubing and sheet, has been completed, after which it is then necessary to unclamp the tubing and leave it free to be folded with the sheet into the finished wall configuration.

SUMMARY OF THE INVENTION

According to a preferred embodiment of the invention, a movable fixture has a plurality of electromagnet units secured in a desired configuration. These electromagnets cooperate with separate permanent magnet units which are arranged to pick up a part such as a tubing serpentine from a loading station and move it into abutting contact with a sheet of magnetic material. The electromagnet is energized through a power supply which can vary both the magnitude and polarity of the current through the electromagnet in such a way as to reinforce the field of the permanent magnet and increase its power for lifting objects and, by reversing the polarity, the electromagnet will repel the permanent magnet to disengage it from the electromagnet so that it may remain behind in a desired position. Thus, when the tubing is moved into the desired position and placed in contact with the sheet, the polarity of the electromagnet is reversed so as to repel the permanent magnets. These magnets then remain in contact with the sheet, where they serve as a temporary clamp to hold the tubing in the predetermined position while the tubing is permanently fastened in place by a suitable means such as the application of a hot melt adhesive. After the adhesive is cooled to hold the tubing in place, the permanent magnets are removed by the electromagnet and returned to operation to pick up the next piece of tubing.

More particularly, the preferred embodiment includes a first elongated table area for receiving a preformed flat sheet of magnetic material, such as steel, from which the four walls of a chest freezer box are formed, either as a liner having evaporator tubing or a shell having condenser tubing secured to the surface adjacent the insulation. The sheet is moved into position on the first table, and at that point has had applied to it elongated beads of a thermal mastic in the areas in which the straight portions of the tubing serpentine are to be attached. On the one side of the first table is a second table having a number of upstanding projections on which the serpentine of tubing, also of a magnetic material such as steel, can be laid out in a predetermined position. Since the tubing is quite flexible, the projections serve to hold it in a precise configuration identical with that which it is to assume when secured to the sheet.

An overhead carriage carries a number of elongated electromagnet members secured to the carriage, which is arranged to move transversely between the first and second tables and upwardly and downwardly with respect to the tubing and the sheet. These electromagnet members comprise a pair of horizontally spaced, vertically extending plates that extend transversely of the sheet for a substantial distance. Permanent magnet members of similar configuration, but having notches on the lower surface, are provided on the basis of one permanent magnet member for each electromagnet. The permanent magnet members, formed of similar vertically extending plates which are spaced horizontally by permanent magnet members, have upper edges arranged to mate with the permanent magnet members, and the notches on the lower side are arranged to receive the tubing in the desired configuration.

With the electromagnets energized to reinforce the permanent magnets, the carriage moves horizontally over the tubing serpentine in place on the second table and is lowered so that the permanent magnet members can engage the tubing with the tubing in the notches and, by means of the attractive force, lift the tubing off the second table while retaining the desired configuration. After the carriage is raised, it is moved horizontally over the first table until it is in the desired position, with the straight portions of the serpentine directly over the beads of thermal mastic. The carriage is then lowered until the tubing carried by the permanent magnet members is in contact with the plate and has pressed the tubing into the beads of thermal mastic. After this has been done, the polarity of the electromagnets is reversed so as to remove the attraction between the electromagnets and the permanent magnets and, by repelling the permanent magnets, cause them to remain in place as a clamp, gripping the sheet by the magnetic force of the permanent magnets. Following this, the carriage and electromagnets are raised and the sheet, with the permanent magnets attached, may be moved laterally to a third table on the other side of the first table and, as the sheet is moved horizontally, and may pass under a plurality of nozzles which discharge a hot melt adhesive onto the tubing and, by bridging the tubing and the sheet, will secure the tubing to the sheet after the adhesive has hardened. In place of the third table, it is possible to use a magazine holding a number of assemblies for cooling purposes, but if only a single third table is used, after the adhesive is cooled, a suitable conveyor can move it back onto the first table, after which the electromagnets are lowered to engage the permanent magnets. The polarity of the electromagnets is then returned to the original polarity attaching the permanent magnets and increased to a value such as to oppose the magnetic field between the permanent magnets and the sheet. The carriage may then be raised, lifting the permanent magnets off the sheet, which may then be moved longitudinally for further fabrication. The raised electromagnets, with the permanent magnets attached, are now free to pick up another piece of tubing to secure it to a subsequent sheet that can be moved into position on the first table.

DESCRIPTION OF THE PREFERRED EMBODIMENT

Figure 1:
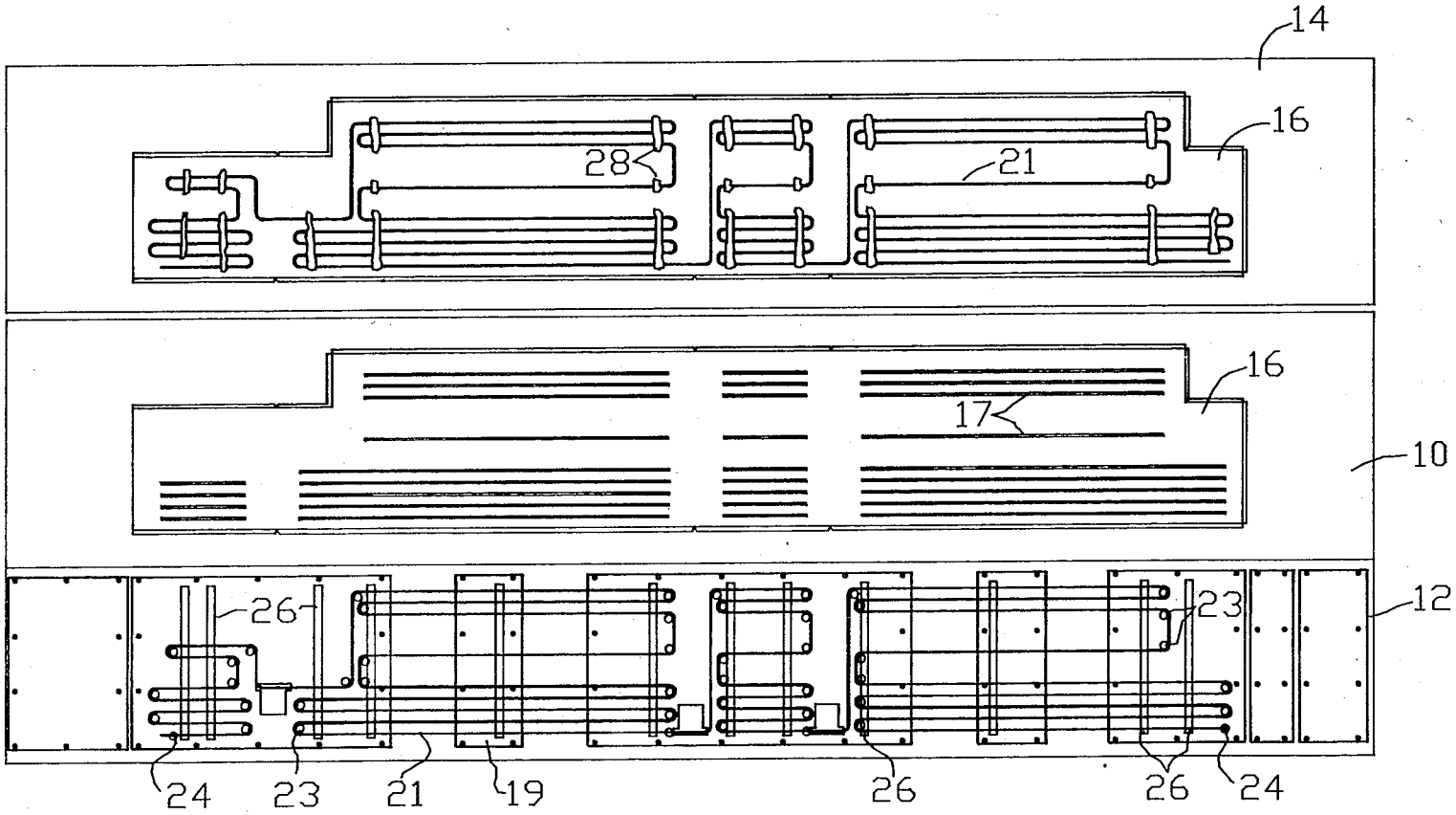
FIG. 1 is a plan view of the apparatus, showing the three tables for holding the tubing, the sheet, and the finished assembly.

Referring now to the drawings in greater detail, FIG. 1 shows a plan view of the three tables or zones involved in the assembly of a heat exchange serpentine tubing member to a flat sheet, such as, in this case by way of example, the inner liner of a chest freezer. The first table or zone 10 is in alignment with a conveyor mechanism adapted to move the sheets in a longitudinal direction along the length of the table so that conveyors move the sheet 16 onto the table 10 in the desired position, and after assembly is complete, remove the sheet 16 to the next stage of operation. On the one side of the first table 10 is a second table or zone 12 on which the tubing serpentine is placed in the desired configuration before assembly, and on the other side of the first table 10 is a third table or zone 14 which is used for cooling the assembled sheet to allow the liquid hot melt adhesive to harden to hold the tubing in place. The third table or zone 14 has been shown as a simple table for purposes of explanation only, since it, in itself, forms no part of the present invention, but in practice the third table or zone 14 may be replaced by a magazine adapted to hold a plurality of sheets for cooling so that they may be cycled and allowed to cool for a number of cycles before being returned to the first table or zone 10 for operation of the conveyors to remove them for further assembly operations.

When the sheet 16 is transported into the desired folding position on the first table 10, the various beads of thermal mastic 17 have already been applied by movement of the sheet through an arrangement of dispensing nozzles, and the sheet is therefore ready to receive the serpentine heat exchanger tubing. While this is being done, a tube serpentine 21, which has previously been bent and formed into its final shape, is positioned on the second table 12, which comprises a group of separate platforms 19 which contain locating cones 23 (see FIG. 3). These cones 23 have cylindrical portions adjacent the platform, and are so positioned that the serpentine is positioned by having its various bends pass around the cones 23, and the cones 23 are of sufficient number and in such locations that the serpentine will be precisely positioned without possible movement on the platforms 19. In addition to the cones 23, V-shaped locators 24 are located and receive the free ends of the tubing to hold them in place. In the apparatus shown in FIG. 1, a plurality of platforms 19 are used, since it is possible to shift them at various positions along the table 12 to accommodate serpentines of different sizes for different sizes of the finished freezers, but the arrangement for moving the platforms 19 has not been disclosed, since it forms no part of the present invention.

As also shown in FIG. 1, with the tubing 21 in position on the second table 12, the indicators noted at 26 and 27 in the form of rectangular boxes represent the locations of the magnet assemblies used for transporting the tubing into position on the sheet 16, as explained in greater detail hereinafter. These magnet positions are so chosen that the magnets will hold the tubing at position 26 adjacent each of the locating cones 23, and if the space between these is relatively long, also at midpoint positions 27, depending upon the flexibility of the tubing. As also shown in FIG. 1, a sheet 16 in position on the third table 14 has the beads of hot melt adhesive 28 already in place, although the permanent magnetic clamps are not shown for purposes of clarity.

Thus, in the assembly sequence, which can be understood from FIG. 1, the sheet 16 first moves into position on the first table 10 while a serpentine 21 is manually placed on the second table 12 around the locating cones 13. The magnet assemblies are located at the positions indicated at 26, then engage the tubing and pick it up off the second table and transfer it over to the first table 10, where the positioning mechanism has the serpentine positioned with the straight portions in vertical alignment with the thermal mastic beads 17. The magnets are then lowered to place the tubing directly in contact with the sheet, with the straight portions being pressed into the thermal mastic. After this is done, the permanent magnets are separated from the electromagnets and as the sheet is move by a transverse conveyor (not shown) onto the third table 13, suitable nozzles dispense the beads of hot melt adhesive 28 which serve to hold the tubing in place on the sheet in the finished position.

Figure 2:
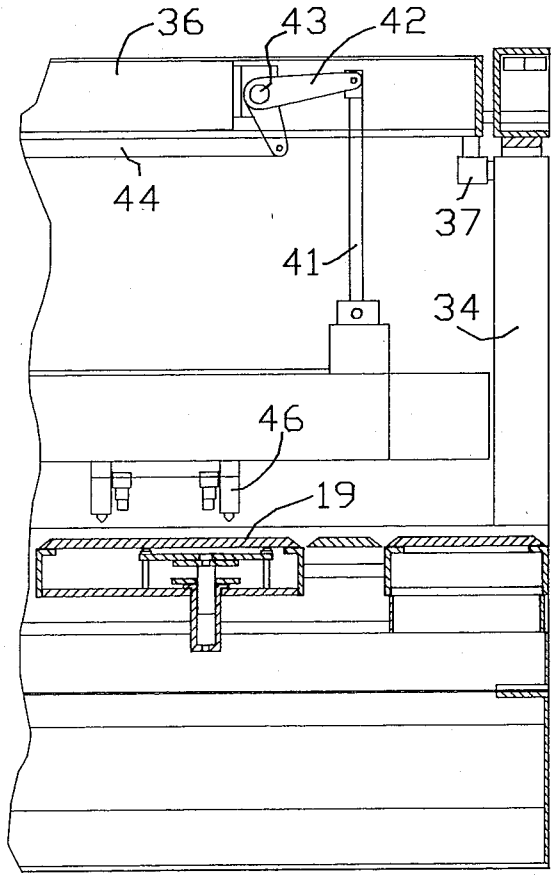
FIG. 2 is a side elevational view, partially in section and broken away, of the apparatus of FIG. 1.
Figure 2:
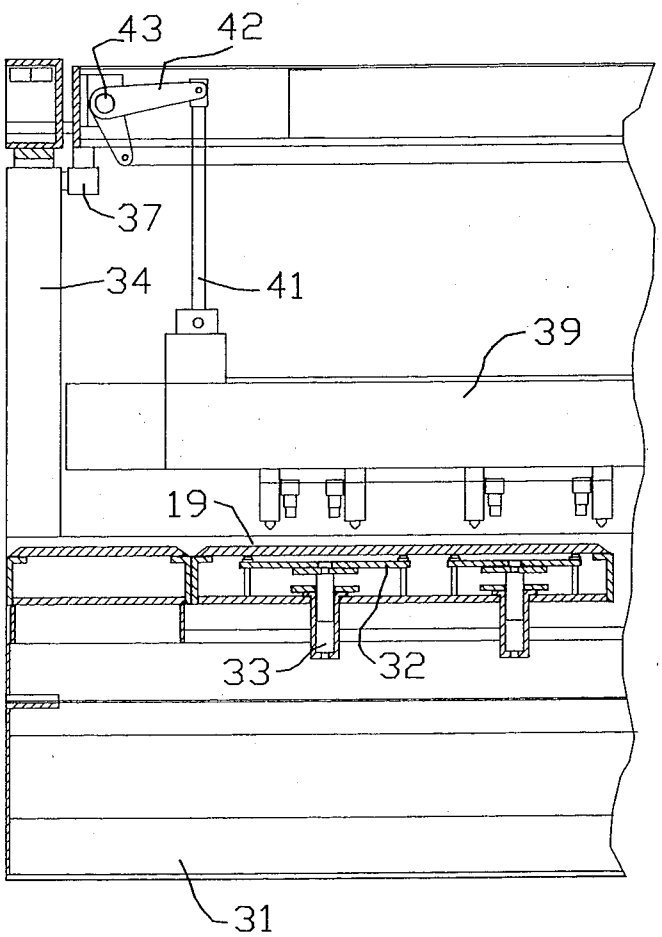
Figure 3:
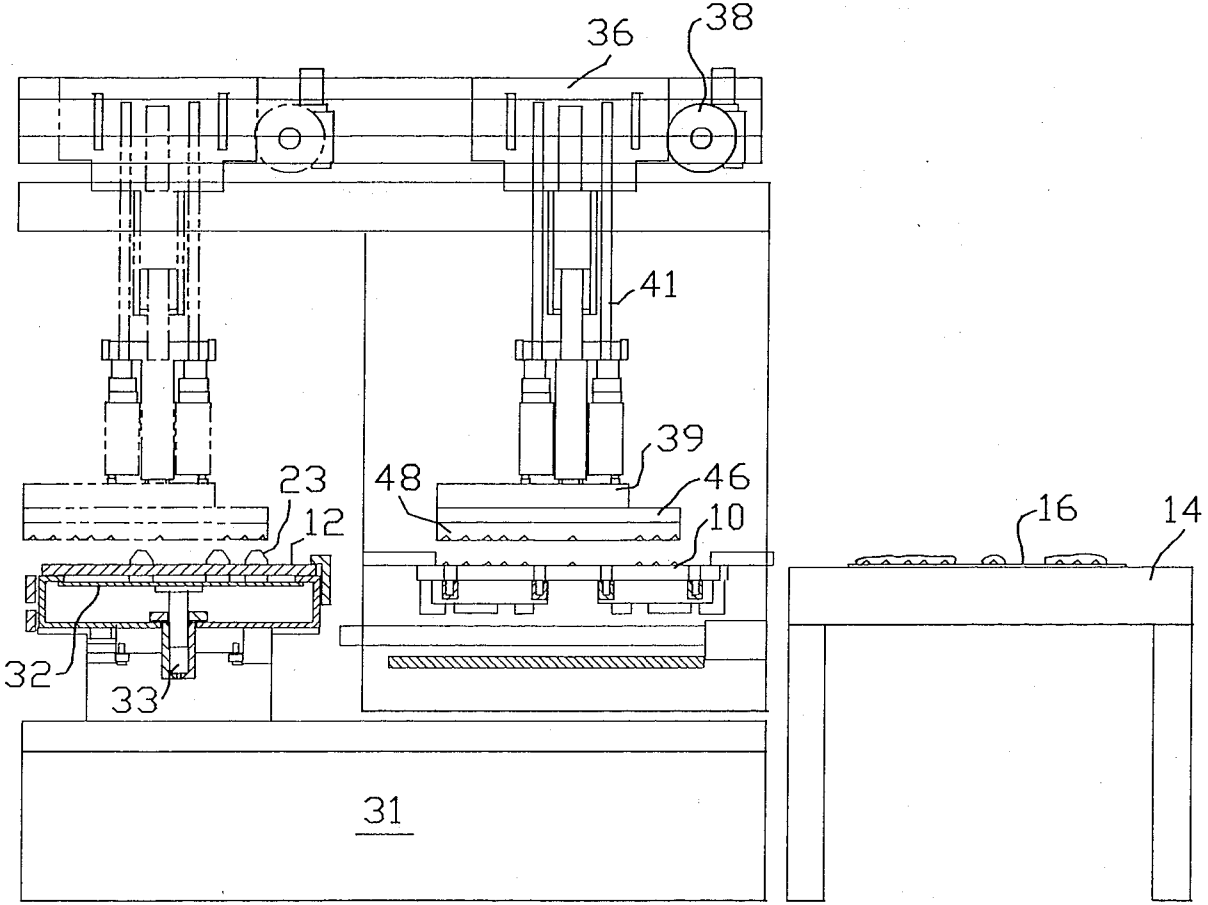
FIG. 3 is an end elevational view, with parts in section, of the apparatus of FIGS. 1 and 2.

Further details of the apparatus are shown in FIGS. 2 and 3. The first and second tables 10 and 12 are mounted on a common machine base 31, and beneath the platforms 19 are mounted plates 32 on which the locating cones 23 and V-locators 24 are secured. A suitable hydraulic cylinder 33 is arranged to raise and lower the plates 32 so that the cones and locators may either project above the surface of the platforms 19 or be recessed below for ease in assembling and removing the serpentine on the table. Frame uprights 34 at each end of the base 31 provide rails 37 on which a trolley 36 is mounted and driven by a suitable drive motor 38 between positions where the trolley is directly over the first table 10 and where it is directly over the second table 12. A carriage 39 is mounted by means of rods 41 and bell cranks 42 pivoted at 43 on the trolley 36 and interconnected by an equalizer rod 44 to allow the carriage 39 to be raised and lowered vertically above the two tables.

On the underside of the carriage 39 are mounted a plurality of mating electromagnet assemblies 46 and permanent magnet assemblies 48 which are shown in greater detail in FIGS. 4–7. Each of these assemblies 46 and 48 is substantially identical except for the configuration to engage the tube serpentine 21, and one such electromagnet assembly 46 is positioned at each of the locations 26 shown in FIG. 1. Thus as shown in that figure, there are 12 separate electromagnet and permanent magnet assemblies which may vary somewhat in their final configuration, depending upon their location and number of tube portions that must be engaged and the arrangement shown in FIGS. 4 to 7 is considered as being typical of any of such electromagnets and its associated permanent magnet.

Figure 4:
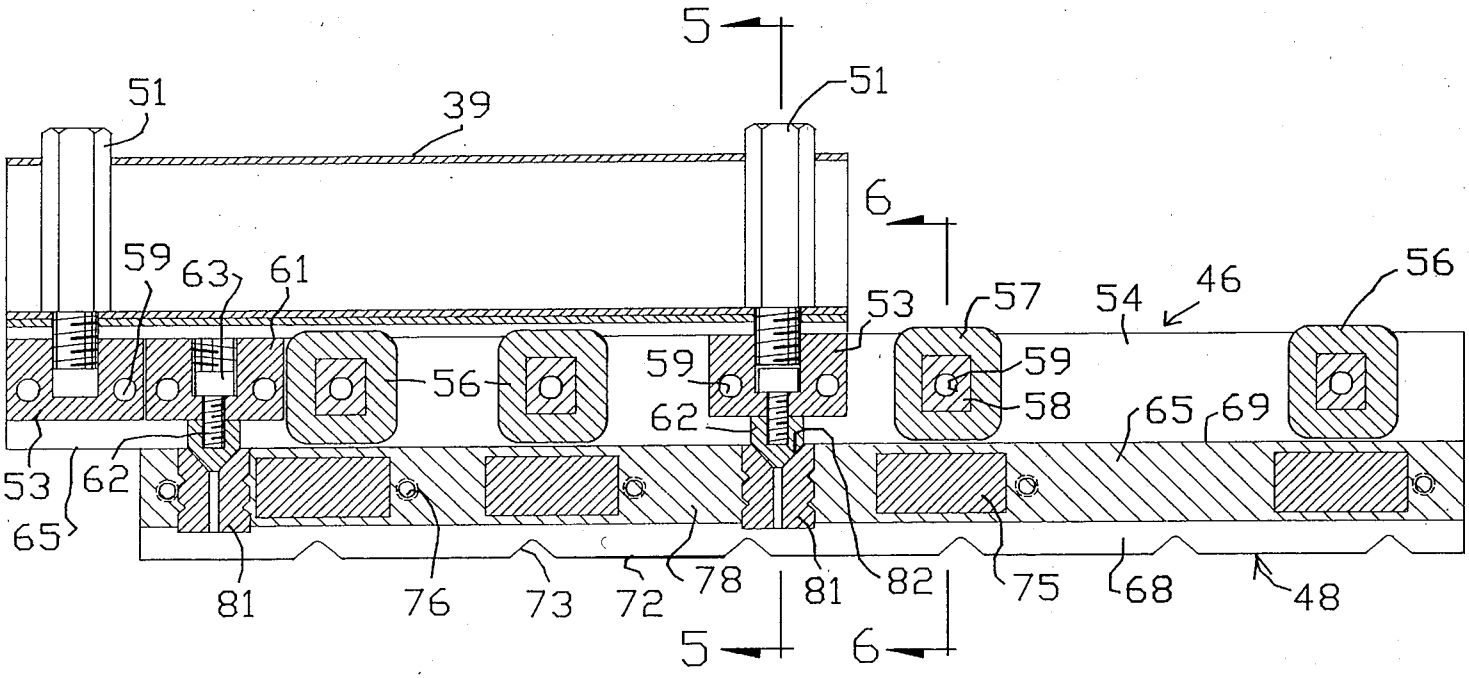
FIG. 4 is an enlarged, fragmentary cross section, showing the mounting of the electromagnet and permanent magnet.
Figure 5:
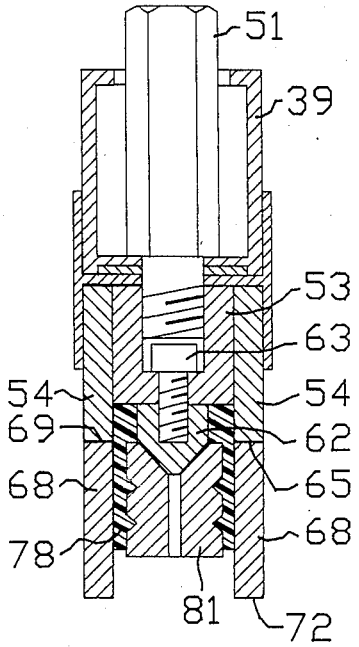
FIG. 5 is a cross-sectional view, taken on the line 5—5 of FIG. 4.

Referring now to FIG. 4 in greater detail, the carriage 39 supports a pair of special bolts 51 which extend downwardly through the carriage to engage a pair of spacer blocks 53. A pair of longitudinally extending, parallel pole plates 54 are arranged on each side of the spacer blocks 53 and at predetermined locations, there are a plurality of electromagnets 56, also positioned between the pole plates 54. Each of the electromagnets 56 includes a coil 57 and steel core 58 which serves also to space the pole plates 54 a uniform spaced distance apart. As indicated at bolt holes 59 passing through the cores 58 and spacer blocks 53, suitable bolts or screws 60 are used to clamp the pole plates 54 together under compression against the cores 58 and spacer blocks 53 to provide a rigid assembly. It will be understood that the coils 57 are all wound identically and connected in series, as explained in greater detail hereinafter, so that when the coils are energized by a direct current, they will generate a magnetic flux having the same magnitude and polarity at each of the electromagnets 56.

As shown in FIG. 4, an extra spacer block 61 has been positioned adjacent the one spacer block merely for purposes of geometry, and the spacer block 61 and one of the other spacer blocks 53 each have locator cones 62 secured to their lower sides by bolts 63 and the locator cones 62 project below lower edges 65 of the pole plates 54. These two locator cones 62 serve to positively position the permanent magnet assembly 48 with respect to the electromagnet assembly 46 and carriage 39.

The permanent magnet assembly 48 includes a pair of spaced, parallel pole plates 68 spaced apart the same distance as the pole plates 54, and having upper edges 69 which make mating contact with the lower edges 65 of pole plates 54 to ensure proper continuity of magnetic flux between the two sets of pole plates. The pole plates 68 have lower edges 72 parallel to the upper edges 69,and these lower edges 72 are provided with suitably spaced and positioned notches 73 adapted to receive the tubing 21 in a position where the outer surface of the tube will be substantially tangent to the lower edge 72. Permanent magnet assemblies 75, which may include one or more stacked individual permanent magnets, are positioned between the pole plates 68, one directly beneath each of the electromagnets 56. The pole plates 68 are also provided with suitable bolt holes 76 spaced away from the permanent magnets 75 but arranged to clamp the pole plates 68 together in the desired position. Because of the spacing lengthwise between the permanent magnets 75, a suitable filler, such as epoxy resin 78, is positioned between the pole plates 68 to provide a rigid assembly for the permanent magnet unit 48. In addition, mounted in the filler 78 are a pair of locator blocks 81 having conical recesses 82 adapted to engage positioning between the permanent magnet assembly 48 and the electromagnet assembly 46.

Figure 8:
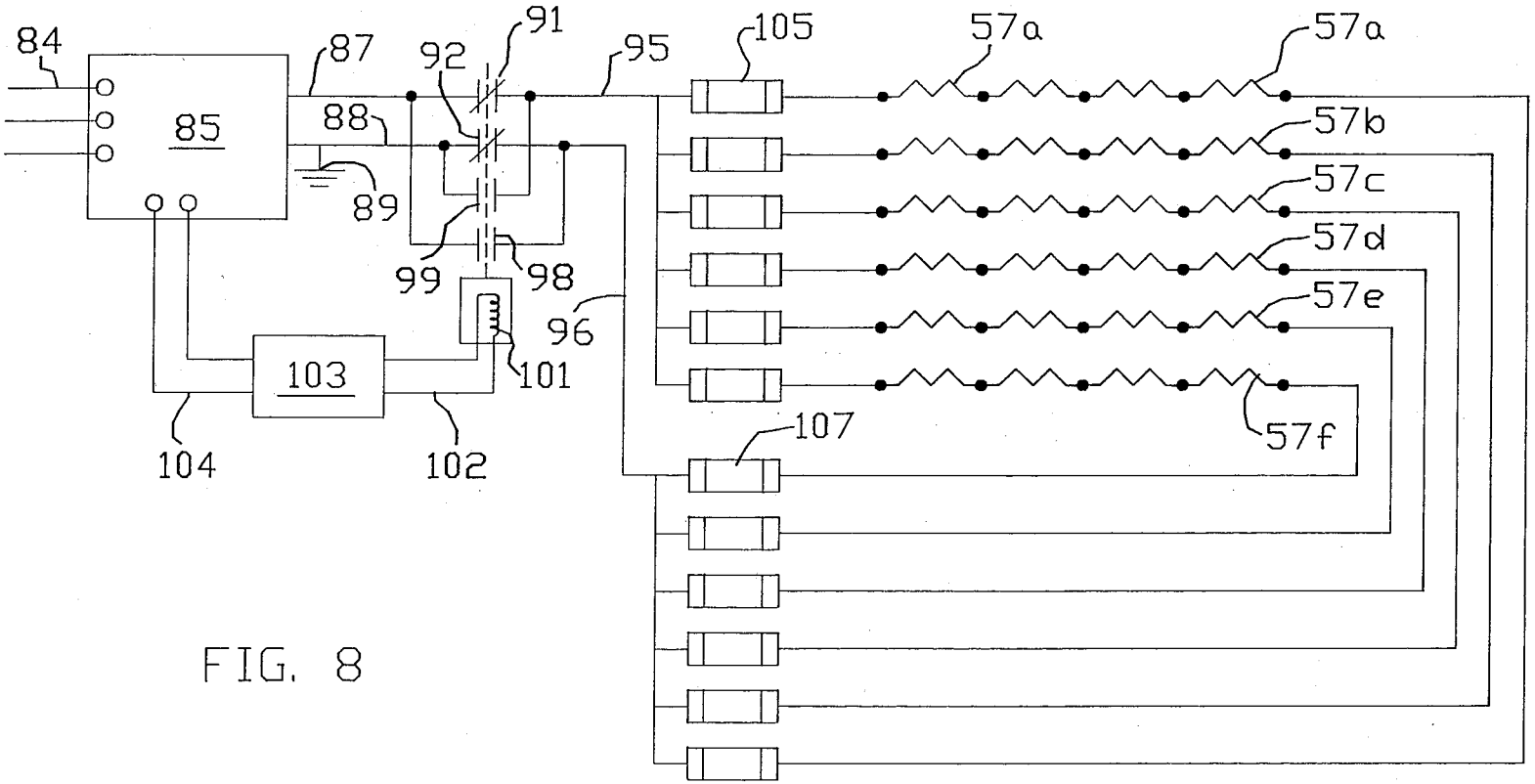
FIG. 8 is a schematic wiring diagram showing the energization of the electromagnets.

The electrical circuit for energizing and controlling the electromagnet coils 57 is shown in FIG. 8. AC power lines 84 supply a constant current DC power supply 85, which may be of any well-known type. The power supply 85 will maintain a constant output current regardless of variations in the AC supply or fluctuations in the load impedance, and will also allow the predetermined constant output current to be varied over a range which may be predetermined sothat the magnetic flux in the electromagnets may be precisely controlled at all times, as described in greater detail hereinafter.

The output of power supply 85 is a pair of DC lines 87 and 88, one of which is preferably grounded as indicated at 89. The lines 87 and 88 connect with normally closed relay contacts 91 and 92, respectively, and the other side of these contacts is connected to lines 95 and 96 and the rest of the circuit. In parallel with the contacts 91 and 92 are a pair of normally open reversing contacts 98 and 99 with the former connecting line 87 to line 96 and the latter connecting line 88 to line 95. These sets of contacts are all operated by a relay 101 and by opening the normally closed contacts 98 and 99, the polarity of the DC power supplied to lines 95 and 96 is reversed. The relay 101 is energized through lines 102 from a control computer, indicated at 103, which is also connected by lines 104 to the power supply 85 to control the output current. The control computer 103 is part of an overall control for an entire assembly line and serves to control the polarity and amplitude of the current supplied by the power supply 85 to the lines 95 and 96.

The line 95 is connected through suitable connectors 105 to the coils 57 of the electromagnets 56. As previously stated, all of the coils 57 in an assembly as shown in FIG. 4 are connected in series, while these coils of a particular assembly are all connected in parallel with the electromagnet in the adjacent sets, as indicated at positions 26 in FIG. 1. Thus, sets of coils 57*a*–57*f* are all connected in parallel, with the one side being connected through connectors 105 to line 95 and the other side being connected by suitable connectors 107 to the line 96. It wil be understood that additional power supplies like 85 may be used also under the control of computer 103 to ensure that all of the electromagnet assemblies attached to the carriage 39 operate in unison.

Figure 7:
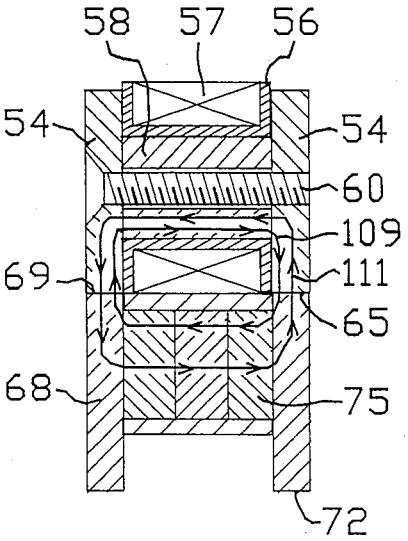
FIG. 7 is a view similar to FIG. 6, showing a flux path for separation of the permanent magnet from the electromagnet.

In operation, a cycle of the equipment involves the manual placement of the serpentine 21 on the table 12, where it assumes the precise position and alignment it is to take after assembly. As the sheet 16 moves into position on table 10, the carriage 39 is moved over table 12, and, with the permanent magnet assemblies attached to the electromagnet assemblies as shown in FIG. 4, the carriage is lowered onto the table 12, with the tubing 21 in engagement with the notches 73 on the bottom of the permanent magnet pole plates 68. The electromagnets are now energized to a first current level, for example 6 amperes, in a first polarity in which the field of the electromagnets reinforces the fields of the permanent magnets. The carriage is now raised to lift the tubing off table 12 and moved horizontally until it is over the sheet 16 on table 10. At that point, the carriage is lowered to place the tubing 21 in the exact position on the sheet 16, with the straight portions of tubing in contact with the beads of thermal mastic. With the carriage now in the lowered position, the polarity of the current through the electromagnets is reversed and increased to a much higher current level, for example 17 amperes, to separate the permanent magnet from the electromagnets. As shown in FIG. 7, at this current level, the flux path of the permanent magnets, as shown in the lines indicated at 109, is exactly opposed by the flux path indicated at 111 for the electromagnets. Since these flux paths are now in opposite directions, they cancel each other to eliminate the magnetic forces between the pole plates 54 of the electromagnet 46 and the pole plates 68 of the permanent magnet 48. When this is done, the carriage may be raised, leaving the permanent magnets 48 on the sheet and clamping the tubing 21 in position. Thus, the tubing will be positively held in place by the permanent magnet assemblies, while the sheet may move sidewise and be transferred to table 14 as the beads of hot melt adhesive 28 are applied for permanent assembly.

Figure 6:
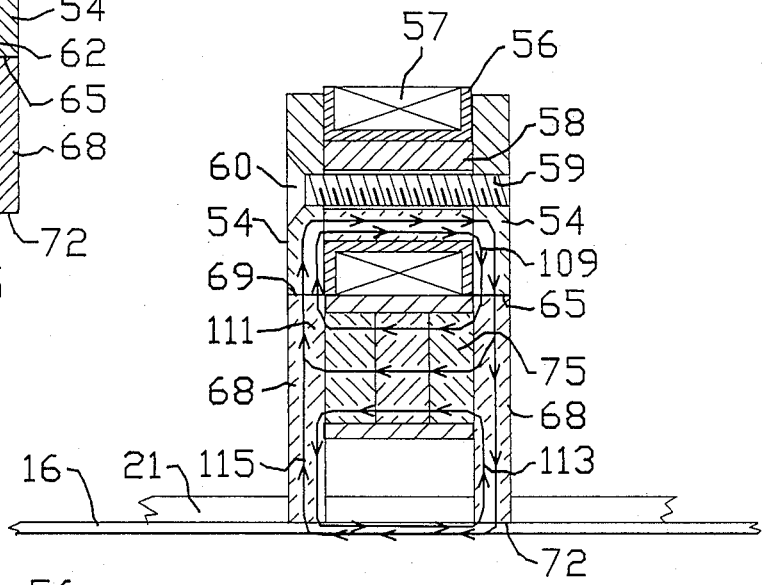
FIG. 6 is an enlarged cross-sectional view, taken on line 6—6 of FIG. 4.

After the hot melt adhesive has cooled, the sheet, with the permanent magnets attached, is transferred back onto the table 10, with the electromagnets engaging the permanent magnet assemblies and the cone 62 in engagement with the recesses 82 to positively position the two assemblies with respect to each other. The polarity in the electromagnets is now again reversed to the original positive polarity and the current increased to a second level, for example 8 amperes, slightly higher than the first level used for picking up the tubing, and the flux patterns of this arrangement are as shown in FIG. 6. In this case, as shown in the upper part, the flux 109 of the permanent magnet and the flux 111 of the electromagnet are in the same direction at the interface between the two sets of pole plates, thus causing the permanent magnet assembly to be firmly gripped by the electromagnet assembly. However, it will now be seen that the flux of the permanent magnet 113 passing through the sheet 16 and tubing 21 is in the opposite direction of the flux 115 from the electromagnet also passing through sheet 16 and tubing 21. Thus, the current value at this second level may be selected to a point where the flux 113 is substantially balanced by the flux 115 so that they cancel and the magnetic attraction between the permanent magnet assembly and the sheet approaches zero. Since there is no longer any attraction, the carriage 39 may now be raised to remove the permanent magnet assemblies 48 from the sheet 16, which can then be removed from the table or zone 10 for further assembly operations. The carriage 39 can then move back to the table 12 to pick up another serpentine of tubing 21, while a subsequent sheet 16 is moved onto the table 10 and the process is repeated.

It should also be noted that force of the permanent magnets is high enough that the permanent magnet assemblies 48 will remain secured to the electromagnet assemblies 46 during transfer, and the electromagnets may be de-energized without affecting the operation of the system.

It will be understood that in the place of the cooling table 14, it is possible to use a moving magazine-type of cooling arrangement which will permit a given sheet to cool for several assembly cycles to ensure that the hot melt adhesive has fully cooled and solidified. If this arrangement is used, the apparatus will require a plurality of permanent magnet units, one for each sheet assembly in the cooling area in addition to the presently working permanent magnet attached to the electromagnet assembly. Thus, the permanent magnet assemblies are cycled in sequence as each fully cooled sheet is removed and a new one added.

It will therefore be seen that in accordance with the present invention, a combination of electromagnets and permanent magnets is used in an assembly operation in which the permanent magnets not only serve to lift one magnetic article and move it into assembly arrangement with a second magnetic article, but are also arranged to be released by the electromagnets to remain behind as a magnetic clamp holding the two articles together for further assembly operations. The electromagnet, in turn, is arranged in one mode to assist the permanent magnet in moving the first article and, by reversing polarity, release the permanent magnet. In the third mode, the electromagnet is used in conjunction with the permanent magnet to ensure attraction between the permanent magnet and the electromagnet, and also the flux of the electromagnet opposes the flux of the permanent magnet so as to reduce the attraction between the permanent magnet and the first and second articles, to allow the permanent magnet member to be removed.

Although the preferred embodiment of this invention has been shown and described in detail, it will be understood that various modifications and rearrangements may be made without departing from the scope of the invention as defined in the following claims.

What is claimed is:

1. A method of assembling a first magnetic member on a second magnetic member utilizing an electromagnet and a separable permanent magnet, comprising the steps of contacting said first member with said permanent magnet held by said electromagnet with said electromagnet being energized at a first current level to reinforce the field of said permanent magnet, moving said electromagnet, said permanent magnet and said first member as a unit to shift said first member into engagement with said second member, reversing the polarity of said electromagnet while energizing it at a second current level to separate said electromagnet from said permanent magnet while leaving said permanent magnet in magnetic engagement with said first and second members, moving said electromagnet away from said permanent magnet, securing said first and second members together by means independent of any magnetic force, moving said electromagnet back into engagement with said permanent magnet, energizing said electromagnet at a third current level to reinforce the field of said permanent magnet, and thereafter moving said electromagnet and said permanent magnet as a unit away from said first and second members.

2. A method as set forth in claim 1, wherein said third current level is higher than said first current level.

3. A method as set forth in claim 2, wherein said second current level is higher than said third current level.

4. A method as set forth in claim 1, wherein said first magnetic member is a tube.

5. A method as set forth in claim 1, wherein said second magnetic member is a sheet.

6. A method of manufacturing a heat exchange member of a refrigeration cabinet of the type having a magnetic sheet metal panel and a magnetic metal tube secured thereto in heat transferring relationship utilizing an electromagnet and a separable permanent magnet, comprising the steps of forming the panel, forming the tube to have a predetermined configuration, placing the tube in a fixture holding the tube in said predetermined configuration, engaging the tubing at a plurality of points with said permanent magnet held by said electromagnet with said electromagnet being energized at a first current level to reinforce the field of said permanent magnet, moving said electromagnet, said permanent magnet, and said tube as a unit to shift said tube into engagement with said panel, securing said tube and said panel together by means independent of any magnetic force, energizing said electromagnet at a second current level to reinforce the field of said permanent magnet, and thereafter moving said electromagnet and said permanent magnet as a unit away from the assembled tube and panel.

7. A method of manufacturing as set forth in claim 6, wherein said second current level is greater than said first current level whereby the magnetic flux of said electromagnet in said tube and sheet opposes the magnetic flux in said tube and sheet from said permanent magnet to permit separation of said permanent magnet from said tube and sheet.

8. A method of manufacturing a heat exchange member of a refrigeration cabinet of the type having a magnetic sheet metal panel and a magnetic metal tube secured thereto in heat transferring relationship utilizing an electromagnet and a separable permanent magnet, comprising the steps of forming the panel, forming the tube to have a predetermined configuration, placing the tube in a fixture holding the tube in said predetermined configuration, engaging the tubing at a plurality of points with said permanent magnet held by said electromagnet with said electromagnet being energized to reinforce the field of said permanent magnet, moving said electromagnet, said permanent magnet, and said tube as a unit to shift said tube into engagement with said panel, reversing the polarity of said electromagnet to separate said electromagnet from said permanent magnet while leaving said permanent magnet in magnetic engagement with said tube and said panel, moving said electromagnet away from said permanent magnet, securing said tube and said panel together by means independent of any magnetic force, moving said electromagnet back into engagement with said permanent magnet, energizing said electromagnet at said original polarity to reinforce the field of said permanent magnet, and thereafter moving said electromagnet and said permanent magnet as a unit away from the assembled tube and panel.

9. A magnet system for assembling first and second magnetic articles comprising a permanent magnet member having first and second pole plates, said pole plates defining a first set of magnetic poles for gripping at least one of said articles, said pole plates also defining a second set of magnetic poles, an electromagnet member having first and second pole plates defining a third set of poles engageable with said second set of poles, means for energizing said electromagnet member with one polarity causing said second and third sets of poles to attract each other, and means for energizing said electromagnet member with a reverse polarity to cause said second and third sets of poles to repel each other to separate said permanent magnet member from said electromagnet member.

10. A magnet system as set forth in claim 9, including mating locator means on said permanent magnet member and said electromagnet member to provide positive positioning of said permanent magnet member with respect to said electromagnet member when said members are in engagement.

11. A magnet system as set forth in claim 9, wherein said permanent magnet member pole plates and said electromagnet member pole plates are elongated, parallel plates having the same spacing.

12. A magnet system as set forth in claim 11, wherein said permanent magnet pole plates and said electromagnet pole plates engage along a single plane.

13. A magnet system as set forth in claim 12, wherein said electromagnet member has a plurality of similar electromagnet coils spaced along a line parallel to said plane.

14. A magnet system as set forth in claim 13, wherein said coils are identical in windings and are wired in series to provide uniform flux from each coil.

15. A magnet system as set forth in claim 14, wherein said permanent magnet member has a light plurality of permanent magnets between said pole plates in opposing alignment with said electromagnet coils.

16. A magnet system as set forth in claim 9, wherein said permanent magnet member pole plates at said first set of poles are shaped to conform with said first article.

* * * * *

UNITED STATES PATENT AND TRADEMARK OFFICE

CERTIFICATE OF CORRECTION

PATENT NO. : 4,801,911

DATED : January 31, 1989

INVENTOR(S) : Graham W. Batts

It is certified that error appears in the above-identified patent and that said Letters Patent is hereby corrected as shown below:

Column 1, line 21, "performed" should read --preformed--

Column 5, line 17, "move" should read --moved--

Column 6, line 24, "spaced" should read --shaped--

Column 6, line 40, after "engage", the following was omitted:

--the mating locator cones 62 to provide positive--

Column 6, line 50, "sothat" should read --so that--

Column 6, line 63, after "contacts", the following was omitted:

--91 and 92 and closing the normally open contacts--

Signed and Sealed this

Fifteenth Day of August, 1989

*Attest:*

*Attesting Officer*

DONALD J. QUIGG

*Commissioner of Patents and Trademarks*